US005650802A

United States Patent [19]

Suzuki et al.

[11] Patent Number: 5,650,802

[45] Date of Patent: Jul. 22, 1997

[54] INK DISPERSION DEVICE FOR LIQUID DROPLET EJECTING APPARATUS

[75] Inventors: Masahiko Suzuki, Nagoya; Yoshikazu Takahashi, Kasugai; Hiroto Sugahara, Ama-gun; Takahiro Kanegae, Nagoya; Masayoshi Kinoshita, Nagoya; Manabu Yoshimura, Nagoya, all of Japan

[73] Assignee: Brother Kogyo Kabushiki Kaisha, Nagoya, Japan

[21] Appl. No.: 415,150

[22] Filed: Mar. 31, 1995

Related U.S. Application Data

[63] Continuation of Ser. No. 112,469, Aug. 27, 1993, abandoned.

[30] Foreign Application Priority Data

Sep. 7, 1992 [JP] Japan ..... 4-238556

[51] Int. Cl.[6] ..... B41J 2/07; B41J 2/165; B41J 2/045

[52] U.S. Cl. ..... 347/9; 347/27; 347/68

[58] Field of Search ..... 347/9, 11, 23, 347/27, 95, 68–70

[56] References Cited

U.S. PATENT DOCUMENTS

| | | | |
|---|---|---|---|
| 4,072,959 | 2/1978 | Elmqvist | 347/68 |
| 4,530,961 | 7/1985 | Nguyen et al. | 106/20 R |
| 4,750,010 | 6/1988 | Ayers et al. | 358/298 X |
| 4,812,856 | 3/1989 | Wallace | 347/95 |
| 4,970,527 | 11/1990 | Gatten | 347/35 X |
| 4,973,980 | 11/1990 | Howkins et al. | 347/68 |
| 5,016,028 | 5/1991 | Temple | 347/69 |
| 5,182,583 | 1/1993 | Horigome et al. | 347/19 |

FOREIGN PATENT DOCUMENTS

| | | | |
|---|---|---|---|
| 58-181655 | 10/1983 | Japan | 347/23 |
| 59-164151 | 9/1984 | Japan | 347/9 |

OTHER PUBLICATIONS

Moss, J.D., "Noncontinuous Dither Excitation of Drop–On–Demand Ink Jet Printer", IBM Tech. Discl. Bulletin, vol. 27 No. 1B, Jun. 1984, pp. 837–838.

"High–Resolution PZT Printhead cuts costs"; Electronic Design, No. 14, Jul. 26, 1990; p. 34.

*Primary Examiner*—David Yockey

*Attorney, Agent, or Firm*—Oliff & Berridge

[57] ABSTRACT

Inkjet printer using opposing walls made of piezoelectric material which oscillate during a print mode at a level sufficient to eject droplets of a disperse-system ink contained in an ink chamber through a nozzle and during a redispersion mode at a level sufficient to disperse cohered and sedimented pigment particles into a substantially homogeneous condition throughout the dispersion medium of the disperse-system ink in the ink chamber, but insufficient for ejecting the ink through the nozzle.

15 Claims, 5 Drawing Sheets

INK DISPERSION DEVICE FOR LIQUID DROPLET EJECTING APPARATUS

This is a continuation of application Ser. No. 08/112,469 filed Aug. 27, 1993, now abandoned.

BACKGROUND OF THE INVENTION

1. Field of the Invention

The present invention relates to a liquid droplet ejecting apparatus and more particularly to the liquid droplet ejecting apparatus having a redispersion mode for redispersing cohered and sedimented solid particles of the ink to be ejected.

2. Description of the Related Art

Many types of liquid droplet ejecting apparatuses are presently used for personal, office, and industrial purposes. Two types of elements are used in these apparatuses to generate energy for ejecting liquids: elements which convert electric energy to thermal energy, such as heat generating elements, and elements which convert electric energy to mechanical energy, such as piezoelectric elements.

Liquids ejected from liquid droplet ejecting apparatuses are usually colored liquids such as black, cyan, yellow, and magenta ink. Inks can be divided into three types: homogeneous solution systems, disperse systems, and thermoplastic solids. Dyes provide color to solution-system inks, pigments provide color to disperse-system inks, and dyes, pigments, or both provide color to thermoplastic-solid inks.

Liquid droplet ejection apparatuses eject liquid droplets which impinge onto a printing medium, such as paper, forming an image thereon. Because images formed by disperse-system inks generally have a higher optical density than those formed from solution-system inks, disperse-system liquids are basically superior for producing high quality printed characters and diagrams.

However, there has been known a problem with liquid droplet ejecting apparatuses for ejecting disperse-system inks in that when not used for long periods of time, secondary cohesion of pigments and other solid materials of the disperse phase occurs from van der Waals force. Cohered solids of the disperse phase can clog nozzles in the recording head, causing liquid ejection misses. Also, the cohered solids can settle out of the dispersion medium, so that concentration of pigments in the ejected droplets is low at the start of printing, degrading quality of the printed characters and diagrams.

Presently, liquid droplet ejecting apparatuses for industry frequently use disperse-system inks. A complicated maintenance structure is often provided to industrial liquid droplet ejecting apparatuses for preventing or clearing clogging problems. Also users must perform periodic and often large scale maintenance.

Liquid droplet ejecting apparatuses for office and personal use, such as inkjet printers, also have similar problems when not used for long periods of time. Consequently maintaining stable quality of recorded images can be difficult. For example, because the nozzles in the printhead of inkjet printers are only a few micrometers in diameter, they are easily clogged by cohered particles of the disperse phase. Also, when recording is attempted while a large portion of the disperse phase is settled out of the disperse medium, the color of recorded images will be thin until the solids are redispersed. There has been a longstanding need for an apparatus that solves these problems to improve quality of liquid droplet ejecting apparatus which use disperse-system inks with pigments as the disperse phase.

SUMMARY OF THE INVENTION

It is therefore an object of the present invention to overcome the above-described drawbacks, and to provide a low priced liquid droplet ejecting apparatus which redisperses cohered and sedimented particles of the disperse phase in the disperse-system liquid to be ejected, without requiring a complicated maintenance structure, for printing characters with more uniform quality.

To achieve the above objectives, a droplet ejecting apparatus according to the present invention for ejecting through a nozzle droplets of a disperse-system liquid including a dispersion medium and a solid disperse phase, the solid disperse phase containing solid particles which cohere and settle out of the dispersion medium with time, includes an oscillating means for oscillating at a level sufficient for dispersing cohered and sedimented solid particles of the disperse-system liquid into a substantially homogeneous condition throughout the dispersion medium but insufficient for ejecting the disperse-system liquid through the nozzle. The oscillating means preferably includes a piezoelectric element.

The droplet ejecting apparatus may further comprise a level determining means for determining the level of oscillation sufficient for dispersing cohered and sedimented solid particles into a substantially homogeneous condition throughout the dispersion medium but insufficient for ejecting the liquid through the nozzle.

The droplet ejecting apparatus may further comprise a mode selecting means for entering the droplet ejecting apparatus into a redispersion mode whereupon the oscillating means oscillates at the level as determined by the level determining means. The mode selecting means preferably includes a manual switch, a plurality of manual switches manipulated in a predetermined series, or an automatic timer circuit with a power backup for automatically periodically entering the droplet ejecting apparatus into the redispersion mode.

The droplet ejecting apparatus may further comprise a redispersion mode duration determining means for determining the duration of the redispersion mode. The redispersion mode duration determining means preferably includes a clock circuit.

When solid particles of the disperse-system liquid to be ejected cohere and settle, the piezoelectric element of the droplet ejecting apparatus with the above structure according to the present invention is oscillated to generate a compression wave in a chamber filled with the liquid. The compression wave efficiently redisperses the solid particles in the disperse-system liquid.

BRIEF DESCRIPTION OF THE DRAWINGS

The above and other objects, features and advantages of the invention will become more apparent from reading the following description of the preferred embodiment taken in connection with the accompanying drawings in which:

FIGS. 5(A), 5(B) and 5(C) show the shape of the piezoelectric element and the diaphragm at points A, B and C respectively of FIG. 4.

DETAILED DESCRIPTION OF THE PREFERRED EMBODIMENTS

A liquid droplet ejecting apparatus according to a first preferred embodiment of the present invention will be described while referring to the accompanying drawings. The first preferred embodiment relates to the liquid droplet ejecting apparatus provided to a printer.

Figure 1:
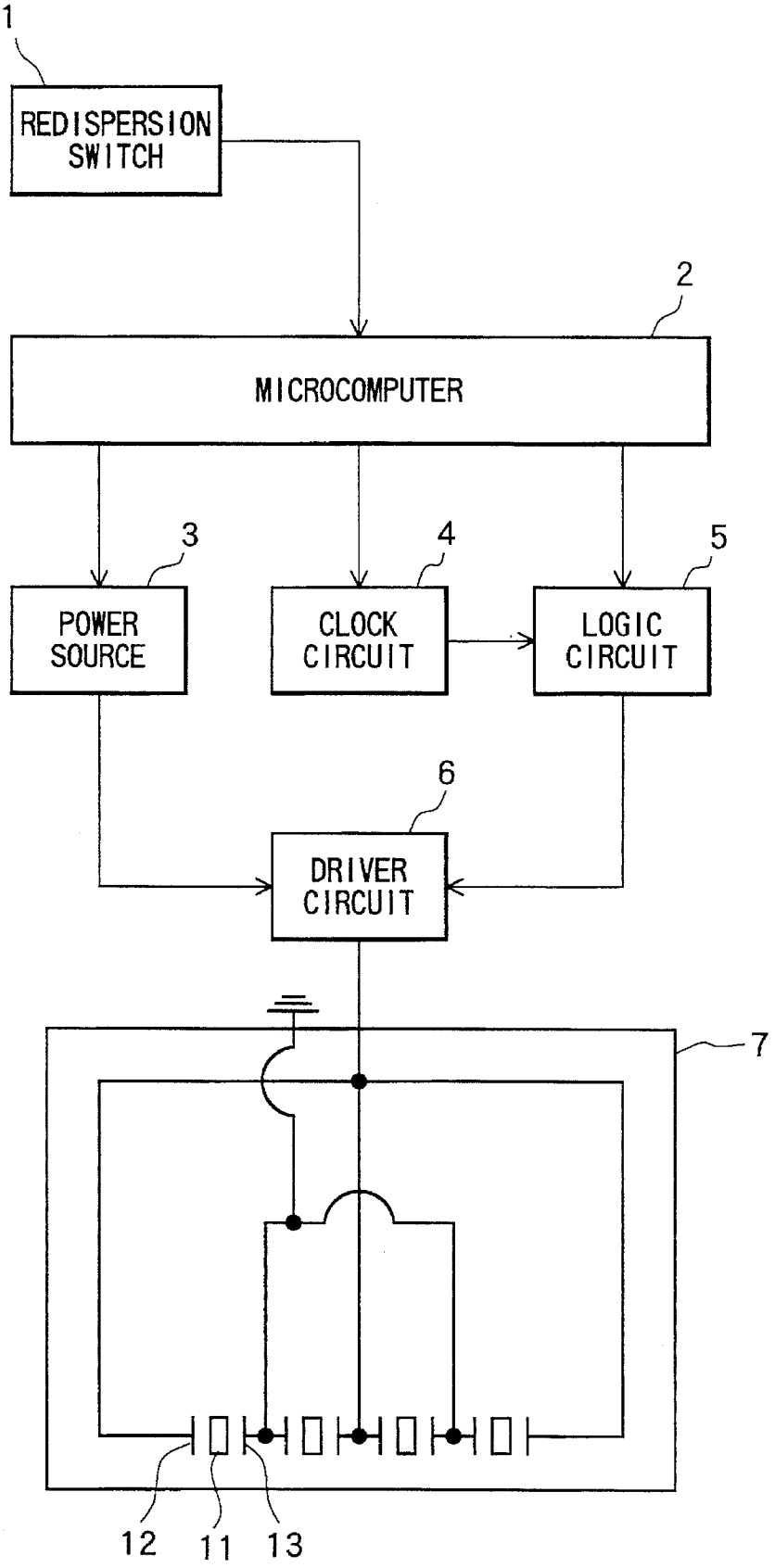
FIG. 1 is a block diagram showing a liquid droplet ejecting apparatus according to a first preferred embodiment of the present invention.

As shown in FIG. 1, a manual redispersion switch 1 is electrically connected to the input of a microcomputer 2. The output of the microcomputer 1 or controller 2, is connected to a power source 3, a clock circuit 4, and a logic circuit 5. The logic circuit 5 also receives output from the clock circuit 4. The outputs of the power source 3 and the logic circuit 5 are connected to a driver circuit 6. The output of the driver circuit 6 is connected to a plurality of piezoelectric elements 11, each having an input terminal 12 and a ground 13. Each piezoelectric element 11 is provided to an ink chamber (not shown) filled with a disperse-system ink. Each ink chamber has a nozzle (not shown) through which the ink is to be ejected. The plurality of piezoelectric elements 11 and the accompanying ink chambers are provided to a print head 7.

The switch 1 can be a switch on the printer control panel (not shown) exclusively for switching the printer from a print mode into a redispersion mode. A user manipulates this switch when he/she feels the color of printed characters appears thin, feels too much time has passed since the printer was last used, or feels printed characters are not printing cleanly because some nozzles are clogged. The switch 1 could also be a predetermined series of switch manipulations for entering the printer into the redispersion mode. This would save space on the control panel. The clock circuit 4 generates a clock pulse for the duration of the redispersion mode. The duration of the redispersion mode required to sufficiently redisperse the ink depends on the shape of the head and the extent to which ink has cohered, and the diaphragm at points A, B and C respectively of but 30 seconds to 5 minutes is probably sufficient. The logic circuit 5 switches between generating a print mode signal and a redispersion mode signal according to the output from the microcomputer 2 and for durations according to an output from the clock circuit 4. The driver circuit 6 generates a signal according to an output from the logic circuit 5. The dispersion mode signal has a wavelength and amplitude with sufficient energy to redisperse the disperse phase of the ink in the ink chamber, but insufficient energy to eject ink from the nozzles. The power source 3 powers the driver circuit 6 according to the output from the microcomputer 2.

When the user manipulates the switch 1, the microcomputer 2 enters the redispersion mode and outputs signals to the power source 3, the clock circuit 4, and the logic circuit 5 accordingly. The power source 3 powers the driver circuit 6 in response to the signal from the microcomputer 2. The clock circuit 4 begins outputting a dispersion mode clock signal with a predetermined duration to the logic circuit 5 which in response outputs the redispersion signal to the driver circuit 6. The driver circuit 6 outputs a drive signal to the plurality of electrodes 12 of the piezoelectric elements 11. The drive signal excites the piezoelectric elements 11 to generate compression waves in their respective ink chambers. The compression waves redisperse cohered and sedimented solids within the disperse-system ink. The frequency, waveform, and voltage of the signal inputted from the driver circuit 6 causes the piezoelectric elements 11 to effectively redisperse the ink without ejecting it from the nozzles. It should be noted that the piezoelectric elements 11 are selectively energized during the print mode and are simultaneously energized during the redispersion mode.

Figure 2:
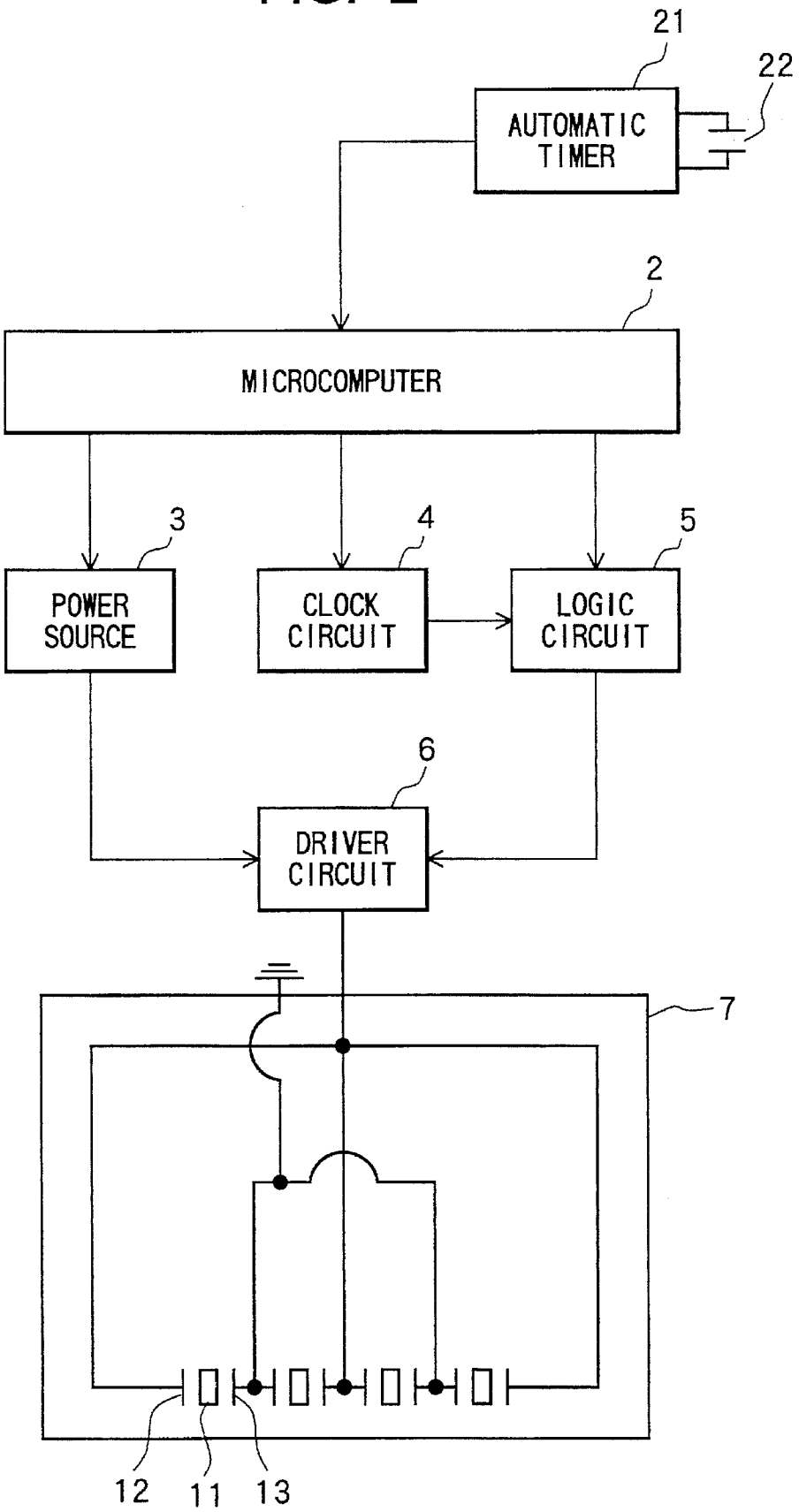
FIG. 2 is a block diagram showing a liquid droplet ejecting apparatus according to a second preferred embodiment of the present invention.

The following text describes liquid droplet ejecting apparatus according to a second preferred embodiment of the present invention. As shown in FIG. 2, the liquid droplet ejecting apparatus according to the second preferred embodiment is constructed the same as the liquid droplet ejecting apparatus according to the first preferred embodiment except that the switch 1 is replaced with an automatic timer 21. A backup battery 22 is provided to the timer 21 for providing power to the timer 21 even when the power of the printer is turned OFF. The timer 21 periodically outputs a signal to the microcomputer 2. If power of the printer is ON, the microcomputer 2 immediately enters the redispersion mode in response to this signal. If power of the printer is OFF, however, the microcomputer 2 will enter the redispersion mode as soon as the power of the printer is next turned ON. The period at which the timer 21 outputs a signal is determined by the tendency of the ink to cohere and settle. After the microcomputer 2 enters the redispersion mode, the operation of the second preferred embodiment is the same as that of the first preferred embodiment, and so its explanation will be omitted here. The second preferred embodiment automatically enters the printer into the dispersion mode without relying on the subjective observation of the user, thus insuring that the printer always prints with ink having uniform pigment concentration.

Next, a first and second concrete example of the present invention will be explained. Because the first and second preferred embodiments differ only by the means for entering the apparatus into the redispersion mode, both concrete examples can be applied to the first and second preferred embodiments.

Figure 3:
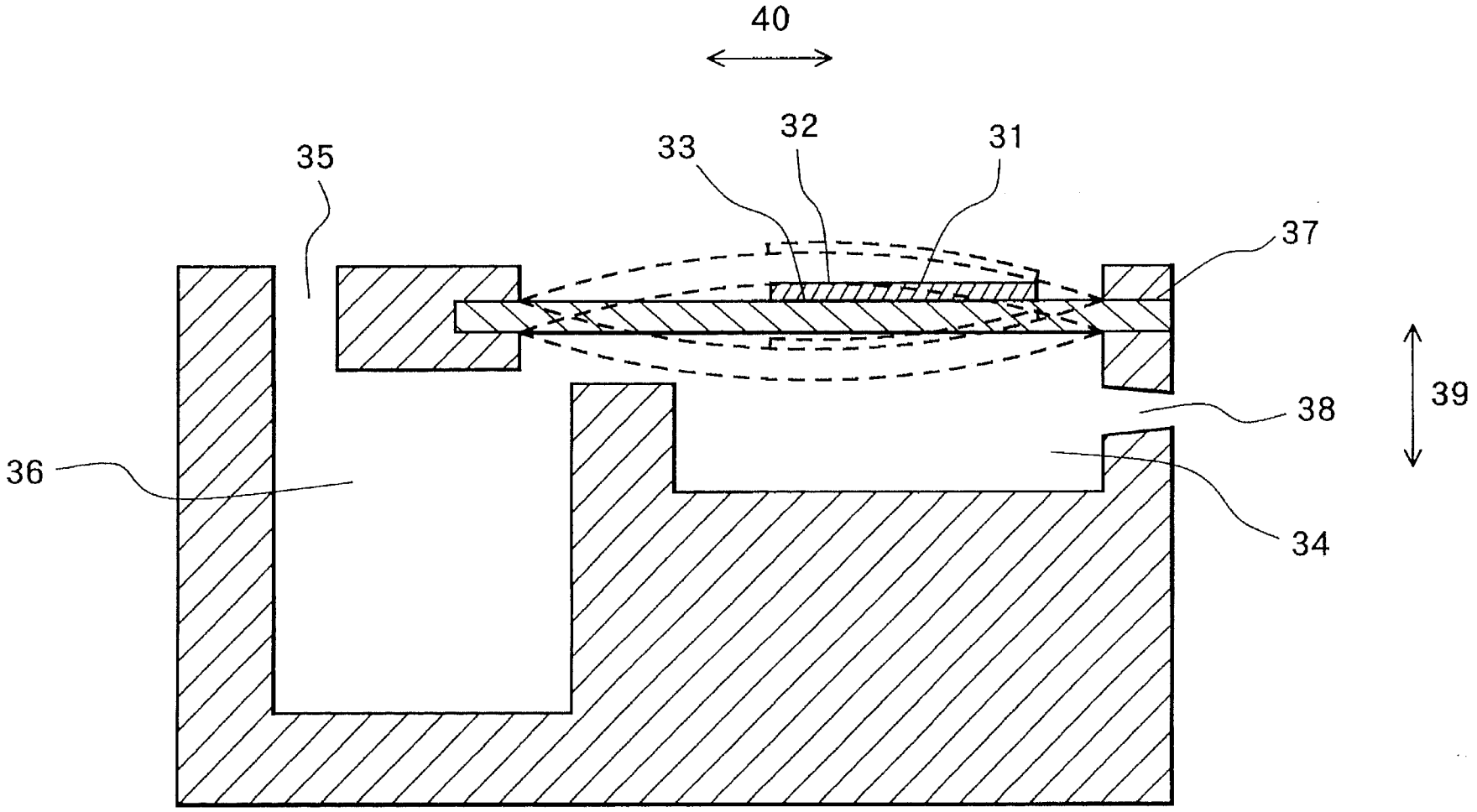
FIG. 3 is a cross-sectional view showing a first concrete example of a print head according to the present invention.

FIG. 3 shows one of a plurality of droplet generators formed in a Ryser-type printhead. Each drop generator includes a piezoelectric element 31, a diaphragm 37, an ink chamber 34, and a nozzle 38. Each ink chamber 34 is in fluid connection with a common ink manifold 36 which connects all the ink chambers 34 of the plurality of drop generators.

The piezoelectric element 31 formed with electrodes 32 and 33 on opposing sides thereof is provided to the diaphragm 37 polarized in a thickness direction (indicated by arrows labeled 39 in FIG. 1). The electrode 32 is an input electrode electrically connected to the excitation circuit as shown in FIG. 1. The diaphragm 37 is bendable in the thickness direction 39 and conforms to deformation of the piezoelectric element 31. The diaphragm 37 forms a side of the ink chamber 34 which is supplied with a disperse-system ink by the ink manifold 36. The nozzle 38 of the drop generator is formed in the side of the ink chamber 34 that, in this example, opposes the ink manifold 36. Ink is supplied to the ink manifold 36 via an ink supply port 35.

During the redispersion mode, the excitation signal from the driver circuit 6 is applied to the electrode 32. Application of the drive signal causes the piezoelectric element 31 to expand and contract in the lengthwise direction (as indicated by the arrow labeled 40) by the piezoelectric effect and electrostrictive strain. The diaphragm 37 deforms with deformation of the piezoelectric element 31, with peaks and troughs described by the broken lines in FIG. 3. The peaks and troughs increase and decrease the volume in the ink chamber 34, generating compression waves in the disperse-system ink filling the ink chamber 34. The compression waves have a force sufficient to redisperse the disperse phase of the ink, but not strong enough to drive ink through the nozzle 38.

Figure 4:
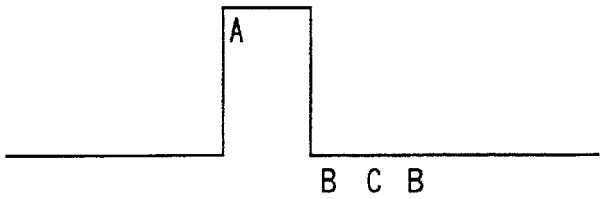
FIG. 4 shows a square waveform representing an exemplary voltage pulse for activating a piezoelectric element of the liquid droplet ejecting apparatus shown in FIG. 3.
Figure 5A:
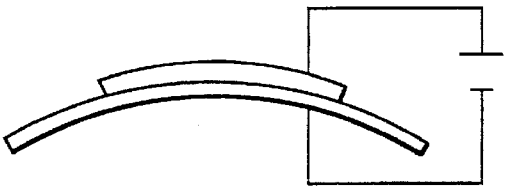
FIGS. 5(A), 5(B) and 5(C) schematically show temporal changes in the shape of the piezoelectric element and the diaphragm shown in FIG. 3 in relation to application of the voltage pulse shown in FIG. 4; that is.
Figure 5B:
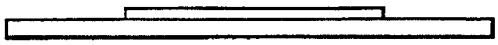
Figure 5C:
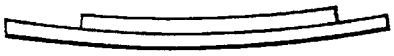

Ink droplets are ejected during the print mode of the printer by applying a square-wave pulse voltage, such as shown in FIG. 4, to the piezoelectric element 31. While voltage is applied to the piezoelectric element 31, as indicated by A in FIG. 4, the piezoelectric element 31 contracts in the lengthwise direction, deforming to the shape shown in FIG. 5(A). This draws ink from the ink manifold 36 into the ink chamber 34. When the voltage is rapidly turned OFF, as indicated by B in FIG. 4, the piezoelectric element 31 reverts to and then overshoots the position shown in FIG. 5(B), to the position shown in FIG. 5(C) (at time C shown in FIG. 4). This generates pressure in the ink chamber 34 that ejects an ink droplet from the ink ejection nozzle 38. The piezoelectric element 31 then comes to rest at the initial position shown in FIG. 5(B).

The inventors produced a print head according to a first example and filled it with a disperse-system ink comprising a solvent, carbon black as the pigment (disperse phase), a disperser, and an additive. To evaluate the effectiveness of the print head, the inventors measured the uniformity of the dispersion of the carbon black in the print head under the five conditions shown in Table 1, that is, directly after the ink was introduced into the ink chambe 34, 30 days after the ink was introduced, 60 days after a the ink was introduced, directly after redispersion operation was performed on ink held in the ink chamber 34 for 30 days, and directly after a redispersion operation was performed on ink held in the ink chamber 34 for 60 days. The disperse phase of the ink was redispersed in situation 4 and 5 shown in Table 1 by applying a +/−35 V voltage in a 20 KHz frequency sinusoidal wave to the electrode 32. As shown in the results listed in Table 1, the ink filling the ink chamber 34 cohered and sedimented about 30 days after filling.

TABLE 1

| | Status of Ink | Level of Dispersion |
|---|---|---|
| 1 | Directly after introduction into ink chamber. | Uniform dispersion. |
| 2 | 30 days after introduction. | Large amounts of cohered particles observed |
| 3 | 60 days after introduction. | Almost all particles cohered. |
| 4 | Directly after redispersion operation was performed on ink held in the ink chamber for 30 days. | Small number of cohered particles observed. Almost uniform dispersion |
| 5 | Directly after redispersion operation was performed on ink held in the ink chamber for 60 days. | Small numbers of cohered particles observed. Almost uniform dispersion. |

Characters printed while the ink in the ink chamber 34 was in this condition had a visually observable deficiency of pigment concentration. Performing the redispersion operation redispersed the ink to almost the same condition as that of directly after filling While referring to FIG. 6, an ink droplet generator array of a print head will be described in a second concrete example of a liquid droplet ejecting apparatus according to the present invention.

Figure 6:
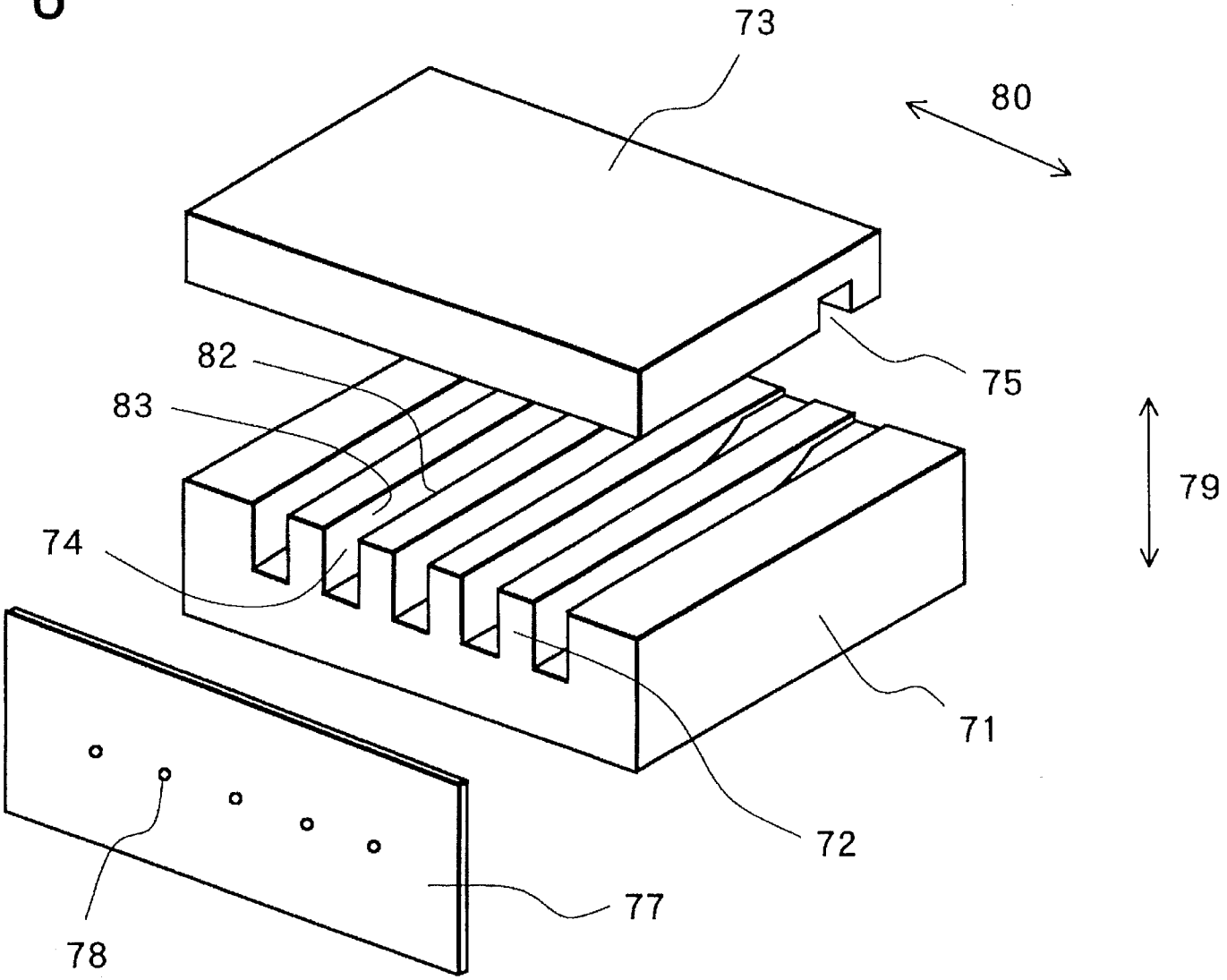
FIG. 6 shows a perspective view of a print head according to a second concrete example of the present invention.

The droplet generator array includes a piezoelectric element plate 71, a cover plate 73, and a nozzle plate 77. The piezoelectric element plate 71 is polarized in its thickness direction (indicated by arrows labeled 79 in FIG. 6). Three-sided grooves, rectangular in cross section, are formed in the piezoelectric element plate 71. Bonding the cover plate 73 to the piezoelectric element plate 71 forms ink chambers 74 formed by walls of the grooves on three sides and by the cover plate 73 on one side. Each of the side walls 72 is deformable in the direction perpendicular to both the polarization direction and the longitudinal direction of the ink chambers 74. Metal electrodes 82 and 83 are formed on opposing groove surfaces of the side walls 72. An ink channel, the ink introduction port 75 of which is shown in FIG. 6, is formed in the cover plate 73 for supplying ink to the ink chambers 74. The nozzle plate 77 includes a plurality of ink droplet ejection nozzles 78 through which ink droplets are ejected. A driving electric field is selectively applied to metal electrodes 82 and 83 to activate the corresponding droplet generator.

To eject ink droplets from one droplet generator of a print head formed in this manner, a driving electric field is applied between the metal electrodes 82 and 83 on opposing side walls 72 of the same ink chamber 74. Because the electric field direction and the polarization direction are orthogonal, both side walls 72 deform inward in the width direction (indicated by the arrows labeled 80 in FIG. 6) according to the piezoelectric thickness shearing effect, reducing the volume of the respective ink chamber 74. The reduction in volume increases pressure in the ink chamber 74 producing a compression wave. The compression wave ejects an ink droplet from the nozzle 78. When the application of the electric field is stopped, the side walls 72 return to their original shape, the volume of the ink chamber 74 increases, and ink is drawn from the ink channel to fill the increase in volume.

The present inventors produced a print head according to the second concrete example and filled it with a disperse-system ink comprising a solvent, carbon black as the pigment (disperse phase), a disperser, and an additive. To evaluate redispersion effectiveness of the print head according to the second concrete example, the present inventors measured uniformity of dispersion of the carbon black in the print head under conditions similar to those used to evaluate the print head according to the first example. The conditions are shown in Table 2. That is, directly after the ink was introduced into the ink chamber 74, 15 days after the ink was introduced, 30 days after the ink was introduced, directly after redispersion operation was performed on ink held in the ink chamber 74 for 15 days, and directly after redispersion operation was performed on ink held in the ink chamber 74 for 30 days. The disperse phase of the ink was redispersed in situation 4 and 5 shown in Table 2 by applying a +/−25 V voltage in a 20 KHz frequency sinusoidal wave to the electrodes 82 and 83. As shown in the results listed in Table 2, the ink filling the ink chamber 74 cohered and sedimented about 15 days after filling. Characters printed while the ink in the ink chamber 74 was in this condition had a visually observable deficiency of pigment concentration. Performing the redispersion operation redispersed the ink to almost the same condition as that of directly after filling. The results of tests on the print head according to the first example and those on the print head according to the second example differ because the dispersion conditions tested and the print head constructions of the two print heads were different.

TABLE 2

| | Status of Ink | Level of Dispersion |
|---|---|---|
| 1 | Directly after introduction into ink chamber. | Uniform dispersion. |
| 2 | 15 days after introduction | Large amounts of cohered particles observed |
| 3 | 30 days after introduction. | Almost all particles cohered |
| 4 | Directly after redispersion operation was performed on ink held in the ink chamber for 15 days. | Small numbers of cohered particles observed. Almost uniform dispersion |
| 5 | Directly after redispersion operation was performed on ink held in the ink chamber for 30 days. | Large amounts of cohered particles observed. |

While the invention has been described in detail with reference to specific embodiments thereof, it would be apparent to those skilled in the art that various changes and modifications may be made therein without departing from the spirit of the invention.

For example, in the first and second preferred embodiments, depending on the output from the microcomputer, the same driver circuit outputs a signal with either the print mode signal or the redispersion mode signal. However, in addition to the driver circuit for producing the print mode signal, an additional separate driver circuit could be provided for producing only the redispersion mode signal.

Also, liquid droplet ejecting apparatuses in the first and second preferred embodiments were described as provided with either a manual switch or an automatic timer for entering the apparatus into the redispersion mode. However, both a manual switch and an automatic timer could be provided to the same liquid droplet ejecting apparatus to provide the benefits of both.

What is claimed is:

1. A dispersion device for use with each ink chamber of a plurality of ink chambers of a droplet ejecting apparatus for ejecting through a nozzle associated with each in chamber droplets of a disperse-system liquid including a dispersion medium and a solid disperse phase, the solid disperse phase containing solid particles which cohere and settle out of the dispersion medium time, comprising:

oscillating means forming at least a portion of each said ink chamber for oscillating at a level sufficient for dispersing cohered and sediment solid particles of the disperse-system liquid into substantially homogeneous condition throughout the dispersion medium but insufficient for ejecting the disperse=system liquid through the nozzle, wherein said oscillating means also form an ejection means for ejecting the disperse=system liquid from the ink chamber, said oscillating means operating in only one of a redispersion mode, for dispersing the cohered and sedimented solid particles, and a print mode, for only ejecting the disperse-system liquid when operating as the ejection means, at a time, said redispersion mode being executed for an established predetermined period of time; and mode selecting means for entering the droplet ejecting apparatus into the redispersion mode whereupon the oscillating means oscillates at a controlled level of oscillation for the established predetermined period of time; wherein said oscillating means comprises:

a pair of opposing walls of each said ink chamber, said walls made of a piezoelectric material, and an electrode formed on each said of opposing walls; and said dispersion device further comprises means for causing said oscillating means to operate in one of the redispersion mode and the print mode.

2. The dispersion device as claimed in claim 1, further comprising:

level control means for controlling the level of oscillation means to be sufficient for dispersing cohered and sedimented solid particles into a substantially homogeneous condition throughout the dispersion medium but to be insufficient for ejecting the liquids through nozzle when in the redispersion mode.

3. The dispersion device as claimed in claim 2, wherein:

the mode selecting means includes a manual switch.

4. The dispersion device as claimed in claim 2 wherein:

the mode selecting means includes a plurality of manual switches manipulated in a predetermined series.

5. The dispersion device as claimed in claim 2, wherein:

the mode selecting means includes an automatic timer circuit with a power backup for automatically periodically entering the droplet ejecting apparatus into the redispersion mode.

6. The dispersion device as claimed in claim 2, further comprising:

redispersion mode predetermined period oftens executing means for executing the established duration of the redispersion mode.

7. The dispersion device as claimed in claim 6, wherein:

The redispersion mode duration executing means includes clock circuit.

8. A dispersion device for use with a plurality of chambers of a droplet ejecting apparatus for ejecting through a nozzle associated with each chamber of said plurality of chambers droplets of a disperse-system liquid including a dispersion medium and a solid disperse phase, the solid disperse phase containing solid particles which cohere and settle out of the dispersion medium With time, comprising:

oscillating means forming at least a portion of each said chamber of said plurality of chambers for simultaneously oscillating said portion of each said chamber of said plurality of chambers at a level sufficient for dispersing cohered and sedimented solid particles of the disperse-system liquid into a substantially homogeneous condition throughout the dispersion medium in each said chamber but insufficient for ejecting the disperse-system liquid through the nozzle, wherein said oscillating means also forms an ejection means for ejecting the disperse-system liquid from the chamber, said oscillating means operating in only one of a redispersion mode, for dispersing the cohered and sedimented solid particles in each said chamber simultaneously, and a print mode, for selectively ejecting the disperse-system liquid only from image forming chambers of said plurality of chambers when operating as the ejection means, at a time wherein said oscillating means comprises:

a pair of opposing walls of each said chamber, said walls made of a piezoelectric material, and an electrode formed on each of said opposing walls; and said dispersion device further comprises means for causing said oscillating means to operate in one of the redispersion mode and the print mode.

9. A dispersion device for use with a plurality of chambers of a droplet ejecting apparatus for ejecting through a nozzle associated with each chamber of said plurality of chambers droplets of a disperse-system liquid including a dispersion medium and a solid disperse phase, the solid disperse phase containing solid particles which cohere and settle out of the dispersion medium with time, comprising:

an oscillator forming at least a portion of each said chamber of said plurality of chambers from simultaneously oscillating said portion of each said chamber of said plurality of chambers at a level sufficient for dispersing cohered and sedimented solid particles of the disperse-system liquid into a substantially homogeneous condition throughout the dispersion medium in each said chamber but insufficient for ejecting the disperse-system liquid through the nozzle, wherein said oscillator also forms an ejection means for ejecting the disperse-system liquid from the chamber, said oscillator operating in only one of a redispersion mode, for dispersing the cohered and sedimented solid particles in each said chamber simultaneously, and a print mode, for selectively ejecting the disperse-system liquid only from image forming chambers of said plurality of chambers when operating as the ejection means, at a time, said redispersion mode being executed for an established predetermined period of time; wherein said oscillator comprises:

a pair of opposing walls of each said chamber, said walls made of a piezoelectric material, and an electrode formed on each of said opposing walls; and said dispersion device further comprises a controller that causes said oscillator to operate in one of the redispersion mode and the print mode.

10. The dispersion device as claimed in claim 9, wherein the controller controls the level of oscillation of the oscillator sufficient for dispersing cohered and sediment solid particles into a substantially homogeneous condition throughout the dispersion medium but to be insufficient for ejecting the liquid through the nozzle when in the redispersion mode.

11. The dispersion device as claimed in claim 9, further comprising a mode selector electrically connected to the controller, said mode selector including a manual switch for entering the droplet ejecting apparatus into the redispersion mode.

12. The dispersion device as claimed in claim 9, further comprising a mode selector electrically connected to the controller, said mode selector including a plurality of manual switches manipulated in a predetermined series for entering the droplet ejecting apparatus into the redispersion mode.

13. The dispersion device as claimed in claim 9, further comprising a mode selector electrically connected to the controller, said mode selector including an automatic timer circuit with a power backup for automatically periodically entering the droplet ejecting apparatus into the redispersion mode.

14. The dispersion device as claimed in claim 9, wherein the controller executes the redispersion mode for an established predetermined period of time.

15. The dispersion device as claimed in claim 9, further comprising a clock circuit electronically connected to the controller for controlling the established predetermined period of time.

* * * * *